US010822573B1

(12) United States Patent
Starkweather

(10) Patent No.: US 10,822,573 B1
(45) Date of Patent: Nov. 3, 2020

(54) POWDER DESCALING COMPOSITIONS AND METHODS FOR USE THEREOF

(71) Applicant: Magnus Procurement and Logistic Solutions, Inc., Irving, TX (US)

(72) Inventor: Harry Starkweather, Irving, TX (US)

(73) Assignee: MAGNUS PROCUREMENT AND LOGISTIC SOLUTIONS, INC., Irving, TX (US)

( * ) Notice: Subject to any disclaimer, the term of this patent is extended or adjusted under 35 U.S.C. 154(b) by 0 days.

(21) Appl. No.: 16/803,581

(22) Filed: Feb. 27, 2020

(51) Int. Cl.

| | |
|---|---|
| ***C11D 7/04*** | (2006.01) |
| ***C11D 7/08*** | (2006.01) |
| ***C11D 7/26*** | (2006.01) |
| ***C23F 1/44*** | (2006.01) |
| ***C23F 14/02*** | (2006.01) |
| ***B08B 1/00*** | (2006.01) |
| ***B08B 3/08*** | (2006.01) |
| ***B08B 9/093*** | (2006.01) |
| ***C11D 3/04*** | (2006.01) |
| ***C11D 3/20*** | (2006.01) |
| ***F25C 3/00*** | (2006.01) |
| ***C11D 11/00*** | (2006.01) |

(52) U.S. Cl.
CPC ..... *C11D 3/042* (2013.01); *C11D 3/2068* (2013.01); *C11D 11/0041* (2013.01); *C23F 14/02* (2013.01); *F25C 3/00* (2013.01); *F25C 2400/12* (2013.01)

(58) Field of Classification Search
None
See application file for complete search history.

(56) References Cited

U.S. PATENT DOCUMENTS

| | | | | |
|---|---|---|---|---|
| 3,042,621 | A * | 7/1962 | Kirschenbauer | C11D 7/08 510/100 |
| 5,858,299 | A * | 1/1999 | Fernholz | C11D 3/1273 264/122 |
| 5,958,854 | A * | 9/1999 | Laing | C11D 3/349 510/218 |
| 2004/0106534 | A1* | 6/2004 | Nitsch | C11D 3/3907 510/220 |
| 2005/0187127 | A1* | 8/2005 | Somerville Roberts | C11D 1/22 510/336 |
| 2005/0250667 | A1* | 11/2005 | Quellet | C11D 17/06 510/444 |
| 2009/0191408 | A1* | 7/2009 | Tian | A61L 15/60 428/402 |
| 2013/0319467 | A1* | 12/2013 | Mohs | C11D 3/2086 134/19 |

FOREIGN PATENT DOCUMENTS

EP 2338960 B1 * 1/2018

* cited by examiner

*Primary Examiner* — Lorna M Douyon
(74) *Attorney, Agent, or Firm* — William R. Childs; Childs Law

(57) ABSTRACT

A powder descaling composition is disclosed herein, as well as methods for using the same. A benefit to the powder descaling composition can be providing a compact, light-weight powder composition that is easily and efficiently transported, stored, dispensed and used for removing scale from the surfaces of machinery.

18 Claims, 1 Drawing Sheet

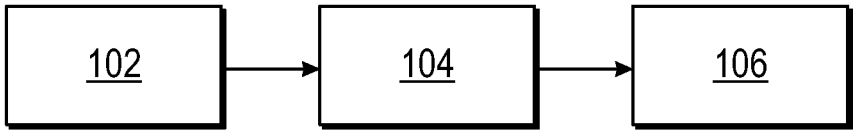
102
104
106

POWDER DESCALING COMPOSITIONS AND METHODS FOR USE THEREOF

TECHNICAL FIELD

A powder descaling composition is disclosed herein, as well as methods for using the same. A benefit to the powder descaling composition can be providing a compact, lightweight powder composition that is easily and efficiently transported, stored, dispensed and used for removing scale from the surfaces of machinery.

BACKGROUND

Descaling products are widely used as cleaning treatments to remove scale and other residues from the surfaces of various appliances. Chemical descaling agents, typically including any of several acids, are used to remove lime scale from metal surfaces in contact with water, such as the surfaces of ice machines and freezers. Descaling agents are also often used to remove scale from metal surfaces that contact hot water, such as boilers and water heaters.

SUMMARY

Embodiments herein are directed to solid powder descaling compositions and methods for descaling a surface using the same. Other embodiments are directed to kits for descaling an ice machine.

In various aspects, a solid powder descaler composition comprises a sulfamic acid powder and a polyethylene glycol (PEG) powder. In an embodiment, the composition includes from about 50% to about 95% by weight of the sulfamic acid powder and from about 5% to about 20% by weight of the polyethylene glycol powder, based on a total weight of the solid powder descaler. In an embodiment, the composition includes from about 90% to about 93% by weight of the sulfamic acid powder and from about 7% to about 10% by weight of the PEG powder, based on a total weight of the solid powder descaler. In other embodiments, the composition includes from about 50% to about 94% by weight of the sulfamic acid powder; from about 5% to about 20% by weight of the polyethylene glycol powder, and from about 1% to about 45% by weight of sodium citrate powder, based on a total weight of the solid powder descaler.

In various embodiments, the sulfamic acid powder and the PEG powder are present in a homogeneous powder mixture. In certain embodiments, the sulfamic acid powder and the PEG powder have an average particle size of from about 100 micrometers to about 700 micrometers. In certain embodiments, the sulfamic acid powder has an average particle size of from about 100 micrometers to about 700 micrometers. In certain embodiments, the powder mixture includes particles having a substantially spherical shape.

In certain embodiments, the PEG powder includes PEG having a weight average molecular weight of from about 1,500 g/mol to about 10,000 g/mol. In certain embodiments, the PEG powder includes PEG having a weight average molecular weight of from about 3600 g/mol to about 4400 g/mol. In certain embodiments, the PEG powder includes from about 5% to 100% by weight of unbranched PEG based on a total weight of the PEG powder. In certain embodiments, the composition excludes from 1% to 100% by weight of PEG having branched polymer chains, based on a total weight of the PEG powder. In certain embodiments, the composition excludes from 1% to 100% by weight of PEG modified with one or more functional groups, based on a total weight of the PEG powder.

In certain embodiments, the composition includes from about 98% to 100% by weight of solid ingredients based on a total weight of the composition when measured at a temperature of 46 degrees Celsius for a duration of 1 hour.

In certain embodiments, the composition excludes hydrochloric acid, phosphoric acid, citric acid, sulfuric acid, a detergent, a corrosion inhibitor, an anti-foaming agent, and an anti-caking agent.

Embodiments herein are directed to methods for descaling a surface. In various embodiments, the method includes providing a solid powder descaler composition, wherein the composition includes sulfamic acid powder and a polyethylene glycol (PEG) powder; forming an aqueous mixture by combining an amount of the composition with a volume of water; and descaling the surface by applying the aqueous mixture to the surface. Certain embodiments of a method include applying the aqueous mixture to the surface by spraying the surface with the aqueous mixture, or by contacting the aqueous mixture with a brush or a sponge, and then applying the brush or sponge to the surface. In certain embodiments, the method includes descaling the surface of an ice machine by applying the aqueous mixture to the surface of the ice machine.

In certain embodiments of a method herein, the amount of the solid powder composition is added to the volume of water at a weight/volume concentration of from about 50 g/L to about 120 g/L. In certain embodiments, the method includes providing the composition in a single-use container and opening the single-use container, then forming an aqueous mixture by pouring the composition from the single use-container into an aqueous mixture or into a part of an ice machine. In such embodiments, the container includes a packet formed of a paper material, a plastic material, a plastic lined paper material, a wax paper, or a combination thereof Certain embodiments of a method herein include dispensing the composition into a dispensing container of an ice machine before forming an aqueous mixture. In certain embodiments, the surface is a surface of an ice machine. In certain embodiments, forming an aqueous mixture is performed by an automatic or manual function of the ice machine. In certain embodiments, the ice machine includes a freezer.

Embodiments herein are directed to kits for descaling an ice machine. In various embodiments, a kit comprises at least one vessel containing an amount of a solid powder descaler composition, wherein the composition includes sulfamic acid powder and a polyethylene glycol (PEG) powder. In certain embodiments, the amount of a solid powder descaler composition ranges from about 50 g to about 120 g. In certain embodiments, the composition includes from about 80% to about 95% by weight of the sulfamic acid powder; and from about 5% to about 20% by weight of the polyethylene glycol powder, based on a total weight of the solid powder descaler.

In certain embodiments, the at least one vessel includes a packet formed of a paper material, a plastic material, a plastic lined paper material, a wax paper, or a combination thereof. In certain embodiments, the at least one vessel includes a single-use packet formed of a paper material, a plastic material, a plastic lined paper material, a wax paper, or a combination thereof.

BRIEF DESCRIPTION OF THE DRAWINGS

The foregoing summary, as well as the following detailed description of the embodiments, will be better understood when read in conjunction with the attached drawings. For the purpose of illustration, there are shown in the drawings some embodiments, which may be preferable. It should be understood that the embodiments depicted are not limited to the precise details shown. Unless otherwise noted, the drawings are not to scale.

FIG. 1 is a flow chart depicting a method of descaling a surface according to some embodiments herein.

DETAILED DESCRIPTION

Unless otherwise noted, all measurements are in standard metric units.

Unless otherwise noted, all instances of the words "a," "an," or "the" can refer to one or more than one of the word that they modify.

Unless otherwise noted, the phrase "at least one of" means one or more than one of an object. For example, "at least one vessel" means one vessel, more than one vessel, or any combination thereof.

Unless otherwise noted, the term "about" refers to ±10% of the non-percentage number that is described, rounded to the nearest whole integer. For example, about 1500 g/mol, would include 1350 to 1650 g/mol. Unless otherwise noted, the term "about" refers to ±5% of a percentage number. For example, about 50% would include 45 to 55%. When the term "about" is discussed in terms of a range, then the term refers to the appropriate amount less than the lower limit and more than the upper limit. For example, from about 50 g/L to about 120 g/L would include from 45 to 132 g/L.

Unless otherwise noted, properties (height, width, length, ratio, etc.) as described herein are understood to be averaged measurements.

Unless otherwise noted, "scale" refers to solid deposits on a surface, including calcium carbonate. Unless otherwise noted, "descaling" refers to removal of solid mineral deposits from a surface, including calcium carbonate.

Unless otherwise noted, the terms "provide", "provided" or "providing" refer to the supply, production, purchase, manufacture, assembly, formation, selection, configuration, conversion, introduction, addition, or incorporation of any element, amount, component, reagent, quantity, measurement, or analysis of any method or system of any embodiment herein.

Descaling products are commonly used to remove scale and other mineral contaminants from the surfaces of various appliances. Troublesome scale buildup in ice machines and freezers is often removed using descaling products. Descaling products are also often applied to clean the surfaces of machinery that come into contact with hot water, including boilers, water distillation equipment, water heaters, coffee machines, and washing machines. Water that is frozen, or that is heated and evaporated from boiling chambers, leaves behind a deposit of minerals and other residues that requires removal from the machine surfaces in order to keep them in good working order.

Ice machines are usually a requirement in today's restaurants, bars, hotels, and hospitals. Frequent cleaning of these machines is necessary due to the problem of lime scale buildup caused by the depositing of dissolved minerals in the water onto the ice freezing surfaces. As the water is frozen over multiple ice making cycles, the lime scale continues to deposit and concentrate. Generally, the higher the mineral content of the water, especially calcium content, the faster the scale forms. As the scale continues to form, it creates a physical obstruction that can clog and restrict water flow, causing the machine to jam. The ice yield is reduced, and eventually the machine will cease to function until it is properly serviced or replaced at great cost. Broken ice machines are not the only concern, however. Ice machines are not only plagued by scale buildup, but also by the growth of mold, slime, and bacteria, all of which can pose a hazard to human health. Proper and frequent cleaning of ice machines is therefore necessary.

Once an ice machine needs scale removal, it must be cleaned with the use of an acid that can dissolve the scale. The acid must not only be effective in dissolving the scale, but must also be food grade in quality and safe to use without damaging the machine. Several acids are commonly used for descaling, depending on the type of appliance or machinery, the severity of the mineral deposits, and the type of materials used to construct the appliance or machinery.

Although several acids have been used in various cleaning compositions, none have been ideal. Common descaling agents include acetic acid, citric acid, glycolic acid, formic acid, phosphoric acid, hydrochloric acid, and sulfamic acid. For example, acetic acid, formic acid, and hydrochloric acids are liquids at room temperature, and strongly acidic liquids are expensive to transport, unsafe to handle without gloves and glasses, and inconvenient to measure in practice. Also, glycolic acid is a solid, but it is hydroscopic such that it tends to attract and retain moisture, turning an easily transported, measured, and dispensed powder into a heavy sludge that is difficult to dispense from conventional packaging. Similarly, phosphoric acid is a powder, but melts at around 108 degrees Fahrenheit, so it only takes one hot truck to cause powder compositions that include this acid to form a sludge, or to re-solidify into a single, difficult to dissolve solid. Citric acid is a robust solid acid, but citric acid is caustic to nickel and steel, which are common metals in ice machines and freezers.

Sulfamic acid is a moderately strong inorganic acid with a melting point of 205 degrees Celsius, so that it remains in a solid state at ambient temperatures. Moreover, sulfamic acid is generally non-hydroscopic, so it retains its powder form when exposed to ambient air. Sulfamic acid can added to water to be used as a descaling agent to remove phosphate and carbonate scale.

However, sulfamic acid suffers from several drawbacks. Sulfamic acid has a relatively low solubility in water, sometimes requiring several applications of acid and successive rinsing cycles to completely remove scale, because the sulfamic acid precipitates out of solution. This drawback wastes employee time, cuts into profits, and is bad for the environment, because more sulfamic acid is used over and over to get the desired result—and much of it ends up going down the drain. Such difficulties can be time consuming and increase the risk of exposure to sulfamic acid during the routine cleaning of equipment. Exposure to sulfamic acid can result in skin problems, burns to the skin and mucous membranes of the eyes, and irritation of the nose, throat and lungs if inhaled. If that wasn't bad enough, concentrated sulfamic acid is corrosive to many metals, which is a critical issue for cleaning ice machines and freezers, because these devices are expected to be washed routinely and frequently for more than a decade of use.

Despite these drawbacks, many liquid descaling products include sulfamic acid by combining it with cleaning agents and stabilizers to keep the sulfamic acid in solution. These products address the water solubility challenges of sulfamic acid. Such products may also contain additives that inhibit the corrosiveness of sulfamic acid. However, liquid products are heavy and bulky, so that they take up a large amount of transport space for shipment. Liquids are also typically more difficult to process through international shipping due to customs regulations. Government regulations may also impose certain requirements for the disposal of containers of liquid materials regarded as hazardous. Moreover, liquids are usually more difficult for workers to measure in practice.

In contrast, products sold as powders can have advantages of lower costs for shipping due to less weight and lower space requirements, as well as generally presenting fewer difficulties for transport due to customs and safety regulations. Packaging for powdered formulations are also generally more convenient and easier to dispose of safely than liquid containers. Powders can also allow the user to mix a more concentrated cleaning solution by increasing the powder to liquid ratio. Packaged powdered products present their own challenges as well. The powdered product needs to flow more or less completely and efficiently out of the packaging when dispensed, without powder particles dispersing into the air, or remaining stuck within the packaging.

There remains a need for solid powder descaler compositions that can provide benefits of compact, lightweight, cost-effective packaging, as well as safe, efficient and easy dispensing of the solid powder descaler for use.

It has been discovered that sulfamic acid and polyethylene glycol (PEG) powder can be combined to form a powder composition, as disclosed herein, which satisfies these needs. This combination of sulfamic acid and polyethylene glycol (PEG) powder can have all the benefits of a powder composition, because these components have high melting points and are non-hydroscopic. Also, it has been found that the combination of sulfamic acid and polyethylene glycol (PEG) dissolves better in water and is less corrosive than when sulfamic acid is used alone. Embodiments of the present disclosure can provide a solid powder descaler composition including a sulfamic acid powder and a polyethylene glycol (PEG) powder. Embodiments herein can provide benefits of a low cost, lightweight, compact composition that can be safely, easily and effectively dispensed for use.

Polyethylene glycol (PEG) has a wide range of uses as an additive to various formulations. Controlling a PEG's molecular weight and size distribution in manufacturing allows a wide variety of physical properties to be achieved. PEGs are available in solid physical forms, including powders, flakes, and pellets. PEGs can be solids at ambient temperatures, yet are generally soluble in water. As solids, PEGs can act as anti-caking agents, absorbing excess moisture in granulated or powdered materials, preventing formation of lumps and improving the flow ability and consumption of such formulations. Solid PEGs can have a lubricity that gives them good qualities as anti-dust agents, dust suppressants and anti-static agents, helping to improve the flow of powdered materials.

Compositions of Various Embodiments

In various aspects, a solid powder descaler composition includes a sulfamic acid powder and a polyethylene glycol (PEG) powder. In an embodiment, the composition includes from about 50% to about 95% by weight of the sulfamic acid powder and from about 5% to about 20% by weight of the polyethylene glycol powder, based on a total weight of the solid powder descaler. In an embodiment, the composition includes from about 60% to about 85% by weight of the sulfamic acid powder and from about 10% to about 15% by weight of the PEG powder, based on a total weight of the solid powder descaler. In an embodiment, the composition includes from about 65% to about 75% by weight of the sulfamic acid powder and from about 10% to about 20% by weight of the PEG powder, based on a total weight of the solid powder descaler. In an embodiment, the composition includes from about 90% to about 93% by weight of the sulfamic acid powder and from about 7% to about 10% by weight of the PEG powder, based on a total weight of the solid powder descaler. Such embodiments can provide a benefit of combining advantageous properties of PEG powder with sulfamic acid powder in a solid powder descaler composition. Such embodiments can provide benefits of a powder descaler composition having advantageous flow properties for ease and completeness of dispensing the composition from packaging for use, and for safety in dispensing due to fewer particles being dispersed into the air, where the particles might be inhaled by a user. If the concentration amount of sulfamic acid powder exceeds 95% and/or the concentration of PEG falls below about 5%, then the composition becomes difficult to dissolve in water and corrosive to metal surfaces. If the concentration of sulfamic acid powder falls below 50%, then the composition is too dilute for practical cleaning.

In other embodiments, the composition includes from about 50% to about 94% by weight of the sulfamic acid powder; from about 5% to about 20% by weight of the polyethylene glycol powder, and from about 1% to about 45% by weight of sodium citrate powder, based on a total weight of the solid powder descaler. In certain embodiments, the composition includes from about 60% to about 85% by weight of the sulfamic acid powder; from about 10% to about 15% by weight of the polyethylene glycol powder, and from about 1% to about 30% by weight of sodium citrate powder, based on a total weight of the solid powder descaler. In certain embodiments, the composition includes from about 65% to about 75% by weight of the sulfamic acid powder; from about 10% to about 15% by weight of the polyethylene glycol powder, and from about 1% to about 25% by weight of sodium citrate powder, based on a total weight of the solid powder descaler. If the concentration of sulfamic acid powder exceeds 75%, then the composition may be prohibited by some governmental safety rules and regulations. Such embodiments can provide a benefit of versatility in descaling properties of the solid powder descaling composition by remaining a solid without using citric acid, which is known to be corrosive to many metal surfaces. Such embodiments can provide an effective concentration of sulfamic acid powder that can comply with governmental standards.

In various embodiments, the sulfamic acid powder and the PEG powder are present in a homogeneous powder mixture. In certain embodiments, the sulfamic acid powder and the PEG powder have a similar average particle size. In certain embodiments, the sulfamic acid powder and the PEG powder have an average particle size of from about 100 micrometers to about 700 micrometers. In certain embodiments, the sulfamic acid powder and the PEG powder have an average particle size of from about 200 micrometers to about 600 micrometers. In certain embodiments, the sulfamic acid powder and the PEG powder have an average particle size of from about 300 micrometers to about 500 micrometers. In certain embodiments, the sulfamic acid powder has an average particle size of from about 100 micrometers to about 700 micrometers. In certain embodiments, the sulfamic acid powder has an average particle size of from about 200 micrometers to about 600 micrometers. In certain embodiments, the sulfamic acid powder has an average particle size of from about 300 micrometers to about 500 micrometers. In certain embodiments, the powder mixture includes particles having a substantially spherical shape or a rounded shape or a granular shape, in comparison to a flake shape. Particle size distribution, the physical form of particles, and particle shape are factors that affect the flow properties of powder formulations. Embodiments of sulfamic acid powder and PEG powder particle size and shape herein can provide benefits of a solid powder descaling composition having advantageous powder flow properties. In certain embodiments, the sulfamic acid powder and the PEG powder particles can include particles that are granular in form. In certain such embodiments, the sulfamic acid and PEG powder particles can have a similar average particle size. Such embodiments can provide benefits of better product flow and of reducing the dispersal of particles into the air when the composition is dispensed from packaging, thus reducing product waste and the formation of potentially hazardous dust, and improving the convenience and accuracy of dispensing the descaling composition. Such embodiments can also provide a benefit of powder particle surface texture, porosity, and wettability that are favorable to the solubility of the particles. In some embodiments, the sulfamic acid powder and the PEG powder include particles that are milled, blended, processed by control sieving, or processed by drying.

In certain embodiments, the PEG powder includes PEG having a weight average molecular weight of from about 1,500 g/mol to about 10,000 g/mol. In certain embodiments, the PEG powder includes PEG having a weight average molecular weight of from about 2,000 g/mol to about 8,000 g/mol. In certain embodiments, the PEG powder includes PEG having a weight average molecular weight of from about 3,000 g/mol to about 6,000 g/mol. In certain embodiments, the PEG powder includes PEG having a weight average molecular weight of from about 3600 g/mol to about 4400 g/mol. Such embodiments can provide a benefit of a PEG powder that is solid at ambient temperatures, and that is readily soluble in aqueous solutions.

In certain embodiments, the PEG powder includes from about 5% to 100% by weight of unbranched PEG based on a total weight of the PEG powder. In certain embodiments, the PEG powder includes from about 25% to about 75% by weight of unbranched PEG based on a total weight of the PEG powder. In certain embodiments, the PEG powder includes from about 50% to about 60% by weight of unbranched PEG based on a total weight of the PEG powder.

In certain embodiments, the composition excludes from 1% to 100% by weight of PEG having branched polymer chains, based on a total weight of the PEG powder. In certain embodiments, the composition excludes from 1% to 100% by weight of PEG modified with one or more functional groups, based on a total weight of the PEG powder. The term "functional group" as used herein includes hydroxyl, methyl, carboxyl, carbonyl, amino and phosphate groups.

In certain embodiments, the composition includes from about 98% to 100% by weight of solid ingredients based on a total weight of the composition when measured at a temperature of 46 degrees Celsius for a duration of 1 hour.

In certain embodiments, the composition excludes hydrochloric acid, phosphoric acid, citric acid, sulfuric acid, a detergent, a corrosion inhibitor, an anti-foaming agent, and an anti-caking agent. The terms "corrosion inhibitor," "anti-foaming agent," and "anti-caking agent" are defined herein to exclude polyethylene glycol (PEG).

Methods for Descaling a Surface of Various Embodiments

Embodiments herein are directed to methods for descaling a surface. As a general overview of a method disclosed herein, referring to FIG. 1, embodiments of the method include providing a solid powder descaler composition 102, wherein the composition includes sulfamic acid powder and a polyethylene glycol (PEG) powder; forming an aqueous mixture 104 by combining an amount of the composition with a volume of water; and descaling the surface 106 by applying the aqueous mixture to the surface. Certain embodiments of a method include applying the aqueous mixture to the surface by spraying the surface with the aqueous mixture, or by contacting the aqueous mixture with a brush or a sponge, and then applying the brush or sponge to the surface. In certain embodiments, the method includes descaling the surface of an ice machine by applying the aqueous mixture to the surface of the ice machine. Such embodiments can provide a benefit of an aqueous mixture that combines the favorable descaling and cleaning properties of sulfamic acid with the versatile and numerous advantageous properties of PEG. In such embodiments, PEG can provide a benefit of increasing the solubility of the sulfamic acid in the aqueous mixture, as well as reducing the corrosive properties of the sulfamic acid. PEG can also provide benefits of forming a film on the surface of the ice machine, increasing the contact of the surface with the sulfamic acid for better descaling and cleaning. PEG can also provide a benefit of reducing foaming that can occur when the aqueous mixture comes into contact with lime, scale and mineral deposits.

In certain embodiments of a method herein, the amount of the solid powder composition is added to the volume of water at a weight/volume concentration of from about 50 g/L to about 120 g/L. In certain embodiments of a method herein, the amount of the solid powder composition is added to the volume of water at a weight/volume concentration of from about 70 g/L to about 100 g/L. In certain embodiments of a method herein, the amount of the solid powder composition is added to the volume of water at a weight/volume concentration of from about 80 g/L to about 90 g/L. Embodiments of a solid powder descaler composition herein can provide a benefit of allowing a user to vary the weight/volume concentration of the solid powder composition in water to achieve a desired concentration of the sulfamic acid and PEG in the aqueous mixture.

In certain embodiments, the method includes providing the composition in a single-use container and opening the single-use container, then forming an aqueous mixture by pouring the composition from the single use-container into an aqueous mixture or into a part of an ice machine. In such embodiments, the container includes a packet formed of a paper material, a plastic material, a plastic lined paper material, a wax paper, or a combination thereof. Such embodiments can provide a benefit of a convenient and easy-to-use packaging in combination with the advantageous flow properties of the solid powder descaler composition. Such embodiments can also provide a benefit of a compact, lightweight, low cost packaging for the solid powder descaling composition that is easy to pack and ship, saving space, time and money.

Certain embodiments of a method herein include dispensing the composition into a dispensing container of an ice machine before forming an aqueous mixture. In certain embodiments, the surface is a surface of an ice machine. In certain embodiments, forming an aqueous mixture is performed by an automatic or manual function of the ice machine. In certain embodiments, the ice machine includes a freezer. Embodiments of the solid powder descaler composition can provide benefits of advantageous flow properties that allow efficient and complete dispensing of the composition into a dispensing container. Such embodiments can provide benefits of saving time that might otherwise be required for the cleaning up of spills, and reducing the safety hazards of working with descaling compositions.

Kits for Descaling an Ice Machine of Various Embodiments

Embodiments herein are directed to kits for descaling an ice machine. In various embodiments, a kit comprises at least one vessel containing an amount of a solid powder descaler composition, wherein the composition includes sulfamic acid powder and a polyethylene glycol (PEG) powder. In certain embodiments, the amount of a solid powder descaler composition ranges from about 50 g to about 120 g. In certain embodiments, the amount of a solid powder descaler composition ranges from about 70 g to about 110 g. In certain embodiments, the amount of a solid powder descaler composition ranges from about 80 g to about 100 g. In certain embodiments, the composition includes from about 80% to about 95% by weight of the sulfamic acid powder; and from about 5% to about 20% by weight of the polyethylene glycol powder, based on a total weight of the solid powder descaler. In certain embodiments, the composition includes from about 85% to about 90% by weight of the sulfamic acid powder; and from about 10% to about 15% by weight of the polyethylene glycol powder, based on a total weight of the solid powder descaler.

In certain embodiments, the at least one vessel includes a packet formed of a paper material, a plastic material, a plastic lined paper material, a wax paper, or a combination thereof. In certain embodiments, the at least one vessel includes a single-use packet formed of a paper material, a plastic material, a plastic lined paper material, a wax paper, or a combination thereof. Such embodiments can provide benefits of compact, lightweight, low cost kits for descaling that are not only easy, efficient, and safer to use than conventional descaler products, but are also easier to ship and to store until the kits are used.

EXAMPLES

This example illustrates the preparation of a solid powder descaler composition according to the embodiments described herein. A solid powder descaler composition can be prepared according to the following:

I. INGREDIENTS

| INGRE-DIENTS | CAS NUMBER | SPECIFICATION: purity, % | Appear-ance | Composition, % w/w |
|---|---|---|---|---|
| Sulfamic acid (s) | 5329-14-6 | 98% | White powder | 65% |
| PEG 4000 | 25322-68-3 | | White powder* | 7.4% |
| Sodium Citrate | 6132-04-3 | | White powder or crystal | 27.6% |

*If the appearance of PEG4000 is pellet, it has to be milled until it forms a powder.

II. Formulation Recipe

1. Weigh sulfamic acid and PEG 4000, and optionally sodium citrate. All ingredients have to be powder with a similar particle size.
2. Thoroughly mix the sulfamic acid and PEG 4000.
3. Check the homogeneity of the mixture.

What is claimed is:

1. A solid powder descaler composition consisting of:
from about 50% to about 95% by weight of a sulfamic acid powder and from about 5% to about 20% by weight of a polyethylene glycol (PEG) powder, and optionally from about 1% to about 45% by weight of a sodium citrate powder, based on a total weight of the solid powder descaler.

2. The composition of claim 1, wherein the composition consists of:
from about 50% to about 95% by weight of the sulfamic acid powder; and
from about 5% to about 20% by weight of the PEG powder,
based on a total weight of the solid powder descaler.

3. The composition of claim 1, wherein the sulfamic acid powder and the PEG powder have an average particle size of from about 100 micrometers to about 700 micrometers.

4. The solid powder descaler composition of claim 1, wherein the sulfamic acid powder and the PEG powder are present in a homogeneous powder mixture.

5. The composition of claim 1, wherein the PEG powder consists of PEG having a weight average molecular weight of from about 1,500 g/mol to about 10,000 g/mol.

6. The composition of claim 1, wherein the PEG powder consists of PEG having a weight average molecular weight of from about 3600 g/mol to about 4400 g/mol; and
wherein the sulfamic acid powder has an average particle size of from about 100 micrometers to about 700 micrometers.

7. The composition of claim 1, wherein the sodium citrate powder is present in the composition.

8. The composition of claim 1, wherein the PEG powder have an unbranched PEG in a range from about 5% to 100% by weight, based on a total weight of the PEG powder; or
wherein the composition excludes from 1% to 100% by weight of PEG having branched polymer chains, based on a total weight of the PEG powder; or
wherein the composition excludes from 1% to 100% by weight of PEG modified with one or more functional groups, based on a total weight of the PEG powder.

9. A solid powder descaler composition consisting of:
from about 90% to about 93% by weight of a sulfamic acid powder;
from about 7% to about 10% by weight of a PEG powder; and
from about 1 to about 45% by weight of a sodium citrate powder,
based on a total weight of the solid powder descaler.

10. The solid powder descaler composition of claim 9, wherein the sulfamic acid powder the PEG powder and the sodium citrate powder are present in a homogeneous powder mixture.

11. A method for descaling a surface comprising:
providing a solid powder descaler composition, wherein the composition consists of from about 50% to about 95% by weight of a sulfamic acid powder and from about 5% to about 20% by weight of a polyethylene glycol (PEG) powder and optionally from about 1% to about 45% by weight of a sodium citrate powder, based on a total weight of the solid powder descaler;
forming an aqueous mixture by combining an amount of the composition with a volume of water; and
descaling the surface by applying the aqueous mixture to the surface.

12. The method of claim 11, comprising descaling the surface of an ice machine by applying the aqueous mixture to the surface of the ice machine.

13. The method of claim 11, wherein the solid powder descaler composition is added to the volume of water at a weight/volume concentration of from about 50 g/L to about 120 g/L.

14. The method of claim 11, further comprising applying the aqueous mixture to the surface by spraying the surface with the aqueous mixture or by contacting the aqueous mixture with a brush or a sponge, and then applying the brush or sponge to the surface.

15. The method of claim 11, further comprising providing the composition in a single-use container and opening the single-use container, then forming an aqueous mixture by pouring the composition from the single-use container into an aqueous mixture or into a part of an ice machine, wherein the single-use container includes comprises a packet formed of a paper material, a plastic material, a plastic lined paper material, a wax paper, or a combination thereof.

16. The method of claim 11, further comprising dispensing the composition into a dispensing container of an ice machine before forming an aqueous mixture; and wherein the surface is a surface of an ice machine.

17. The method of claim 16, wherein the forming an aqueous mixture is performed by an automatic or manual function of the ice machine.

18. The method of claim 12, wherein the ice machine comprises a freezer.

* * * * *